United States Patent [19]

Ragaller

[11] 4,237,356

[45] Dec. 2, 1980

[54] ELECTRICAL COMPRESSION SWITCH WITH CONTACT MOVEMENT ASSISTOR

[75] Inventor: Klaus Ragaller, Neuenhof, Switzerland

[73] Assignee: BBC Brown, Boveri & Company Limited, Baden, Switzerland

[21] Appl. No.: 787,215

[22] Filed: Apr. 13, 1977

[51] Int. Cl.[3] ..... H01H 33/88

[52] U.S. Cl. ..... 200/148 A; 200/150 G

[58] Field of Search ..... 200/148 A, 150 G

[56] References Cited

U.S. PATENT DOCUMENTS

| | | | |
|---|---|---|---|
| 3,975,602 | 8/1976 | Hertz et al. | 200/148 A |
| 3,987,261 | 10/1976 | McConnell | 200/148 A |

*Primary Examiner*—Robert S. Macon

*Attorney, Agent, or Firm*—Burns, Doane, Swecker & Mathis

[57] ABSTRACT

An electrical compression switch operating with a compressed gaseous arc quenching medium comprises a switch chamber containing a pair of disengageable contacts one of which is a pin contact and the other a tubular nozzle contact surrounded by a tubular nozzle made from insulating material engageable with the pin contact and which surrounds the tubular nozzle contact in spaced relation to form a compression chamber. An expansion chamber is secured to the end of the tubular nozzle of insulating material and a differential piston operates within the latter and also within the compression chamber. A switch drive effects movement of the pin contact and differential piston considered as one unit relative to the tubular nozzle contact, the tubular nozzle of insulating material and the quenching medium expansion chamber considered an another unit to effect disengagement of the switch contacts as well as relative movement between the differential piston and tubular nozzle of insulating material in such direction as to decrease the volume of the compression chamber and thereby increase the pressure of the quenching medium at the arc which together with the thermal energy of the arc assists in the switch drive and also assists in arc extinction.

9 Claims, 8 Drawing Figures

3
S
9b
10
5a
5d
9
2
1c
K
9c
1a
7
5
1
6b
6f
5c
6a
1b
6
1d
8
6e
L

3
S
10
5d
9
2
K
13
7
1
6f
13a
1e
6a
1f
12
6
8
L

ELECTRICAL COMPRESSION SWITCH WITH CONTACT MOVEMENT ASSISTOR

BACKGROUND OF THE INVENTION

The invention concerns a method to assist the drive of at least one moving switch part of an electric compression switch with a quenching medium flow which is generated during the switching-off process by means of a compression device, as well as an electric compression switch, designed in accordance with this method, where the arc arising across the switch components is quenched by the flow of the quenching medium, and where the compression device consists primarily of a piston coacting with a quenching-medium compression chamber.

It is known to blast the arc arising within electric switches, especially by means of a gas flow, where the blast flow by a quenching medium is generated by means of a piston coacting with a quenching-medium compression chamber and driven with the aid of an external drive as shown for example by Swiss patent CH-PS 519, 238.

Switches of this type, when designed for breaking increasingly heavy currents, do require external drives of correspondingly greater motive forces.

SUMMARY OF THE INVENTION

It is the principal object of the invention to utilize the thermal energy of the arc, arising within the switch, at least partially to generate the quenching medium flow, i.e., the blast flow, and thus to assist in the drive of the moving switch parts of an electric compression switch, for example, an $SF_6$-blast-piston switch.

The invention solves this problem in that manner that the quenching medium which is present within the compression switch is highly compressed by one end of a piston coacting with a quenching-medium compression chamber, preferably a differential diameter piston, and the highly compressed quenching medium is hereby released to act upon the arc as a quenching flow, that hereby at least one portion of the quenching medium, heated by the arc and placed under increasing pressure, is expanded in a quenching-medium expansion chamber and thereby the other end of the piston and at least one part of the boundary of the quenching-medium expansion chamber are moved, or driven respectively, from one another, and that this portion of the quenching medium during the final period of the switch-off process is diverted from the quenching-medium expansion chamber to a lower pressure region of the quenching-medium compression chamber as well as the quenching-medium expansion chamber, and preferably to the quenching chamber of the compression switch.

This arrangement will be particularly advantageous if the quenching medium that is present within the compression switch is highly compressed by means of a differential diameter piston in that manner that it is compressed by the end of the piston having the smaller piston area end within a quenching-medium compression chamber and the quenching medium flow is being released by at least one component of the compression switch from the quenching-medium compression chamber to act upon the arc arising across this switch element, if at least one portion of the quenching medium, heated by the arc, is injected by a nozzle element of the switch, forming the arc in conjunction with said switch element, into a closed quenching-medium expansion chamber, its volume variable in coaction with the end of the differential piston possessing the larger area so that the end of the piston having the larger area as well as the inner boundary of the quenching-medium expansion chamber are loaded by the expanding quenching medium by at least a mean pressure, thus causing the differential diameter piston and at least one portion of the boundary of the quenching-medium expansion chamber to move relative to one another, and to draw off the quenching medium during the final period of the switch-off process through pressure-equalizing apertures from the quenching-medium expansion chamber into its region of lower pressure or into the region of the quenching-medium compression chamber possessing lower pressure than the quenching-medium expansion chamber, and preferably into the quenching chamber of the compression switch.

It will be expedient if the quenching medium flow is formed by a gas flow.

In the case of a preferred species, the piston is designed in the form of a substantially tubular differential-diameter piston where the piston end with the smaller area runs between the portion of a switch element facing the arc and designed in the form of a nozzle element and between an insulating nozzle surrounding the last-mentioned part at a specific distance, this smaller area piston end, arranged quenching-medium-tight, forming a quenching-medium compression chamber together with one portion of the outer wall of the switch nozzle element, one portion of the inner wall of the insulating nozzle and the switch element engaging the insulating nozzle and the switch nozzle element when in the on-position, where the switch nozzle element is fastened by positioning and holding parts to the end of the insulating nozzle facing the arc, and the insulating nozzle is connected at its other end to the boundary of a closed quenching-medium expansion chamber, its volume variable in coaction with the differential diameter piston, where the switch nozzle element unsupportedly leads into the quenching-medium expansion chamber, and the larger area end of the differential diameter piston runs quenching-medium-tight between the unsupported part of the switch nozzle element and one part of the inner boundary of the quenching-medium expansion chamber, and the boundary of the quenching-medium expansion chamber is provided with apertures for pressure equalization of the quenching medium, the apertures being cleared during the period of current turn-off by the last-mentioned part of the differential diameter piston for access to the region of the quenching-medium expansion chamber as well as the quenching-medium compression chamber, and especially to the quenching chamber of the compression switch.

In a further development of the invention there is at least one moving part of a compression device coupled with at least one switch element of the compression switch, thus facilitating the drive of several moving switch elements of the electric compression switch.

In the case of one species the switch nozzle element, connected with the insulating nozzle by way of positioning and fastening parts, is arranged thusly that it is movable, especially in its axial direction, relative to the boundary of the quenching-medium expansion chamber, while the differential diameter piston remains stationary relative to the parts mentioned above.

In the case of another species the switch nozzle element, connected with the insulating nozzle by way of positioning and fastening parts, is arranged thusly that it is stationary relative to the boundary of the quenching-medium expansion chamber, while the differential diameter piston is coupled by means of an insulating part to the switch element coacting with the switch nozzle element, and the last-mentioned parts are arranged thusly that they can change their positions relative to the first-mentioned parts, and especially are movable in the axial direction of the switch nozzle element.

Furthermore, it is advisable to provide between the quenching-medium expansion chamber and the quenching chamber at least one non-return valve which in case of switching operations involving low currents will prevent the formation of a negative pressure in the quenching-medium expansion chamber relative to the quenching chamber.

By taking into consideration the turn-on of the compression switch, another non-return valve should at least be arranged between the quenching-medium compression chamber and the quenching-medium expansion chamber in such manner that the pressure in the expansion chamber will not be greater than the pressure in the compression chamber.

The main advantage attained by the invention is due to the fact that the quenching medium heated by the arc generated by the switching process, i.e., in case of a switch utilizing gaseous quenching means, the hot gases are not conducted as heretofore into the chamber volume or quenching chamber respectively but are utilized in a closed space, the quenching-medium expansion chamber, to accomplish a pressure increase $p_K$ over the initial pressure $p_O$ of the quenching medium that is present within the compression switch.

This has the effect from an engineering standpoint that the thermal energy of the arc, generated in the course of the switching process and subjected to a flow or blast by the quenching medium, obtained in the form of a pressure increase $p_K$ at the low pressure side of the medium flow, is now utilized for performance efficiency.

The preferred solution, as previously described, is the use of a differential diameter piston, its smaller area end facing the high-pressure side, i.e., the quenching-medium compression chamber, and its larger area end facing the low pressure side, i.e., the quenching-medium expansion chamber.

An additional advantage results from the fact that the differential diameter piston makes it possible to utilize and amplify a relatively low pressure increase $p_K$ for the build-up of the much higher pressure $p_O+p_H$ in the quenching-medium compression chamber, where $p_H$ denotes the pressure increase by the compression in the quenching-medium compression chamber.

There is the further advantage that toward the end of the switch-off operation, i.e., the blast movement, respectively, the closed quenching-medium expansion chamber, its volume being variable, is connected with the quenching chamber by way of apertures which equalize the pressure of the quenching medium, thereby avoiding a counterflow of the quenching medium through the switch nozzle element, and preventing in particular hot gases from entering the quenching section.

BRIEF DESCRIPTION OF THE DRAWINGS

Practical examples of the invention are illustrated in a simplified manner by the accompanying drawings and are explained below in detail.

DETAILED DESCRIPTION OF PREFERRED EMBODIMENTS

Figure 1:
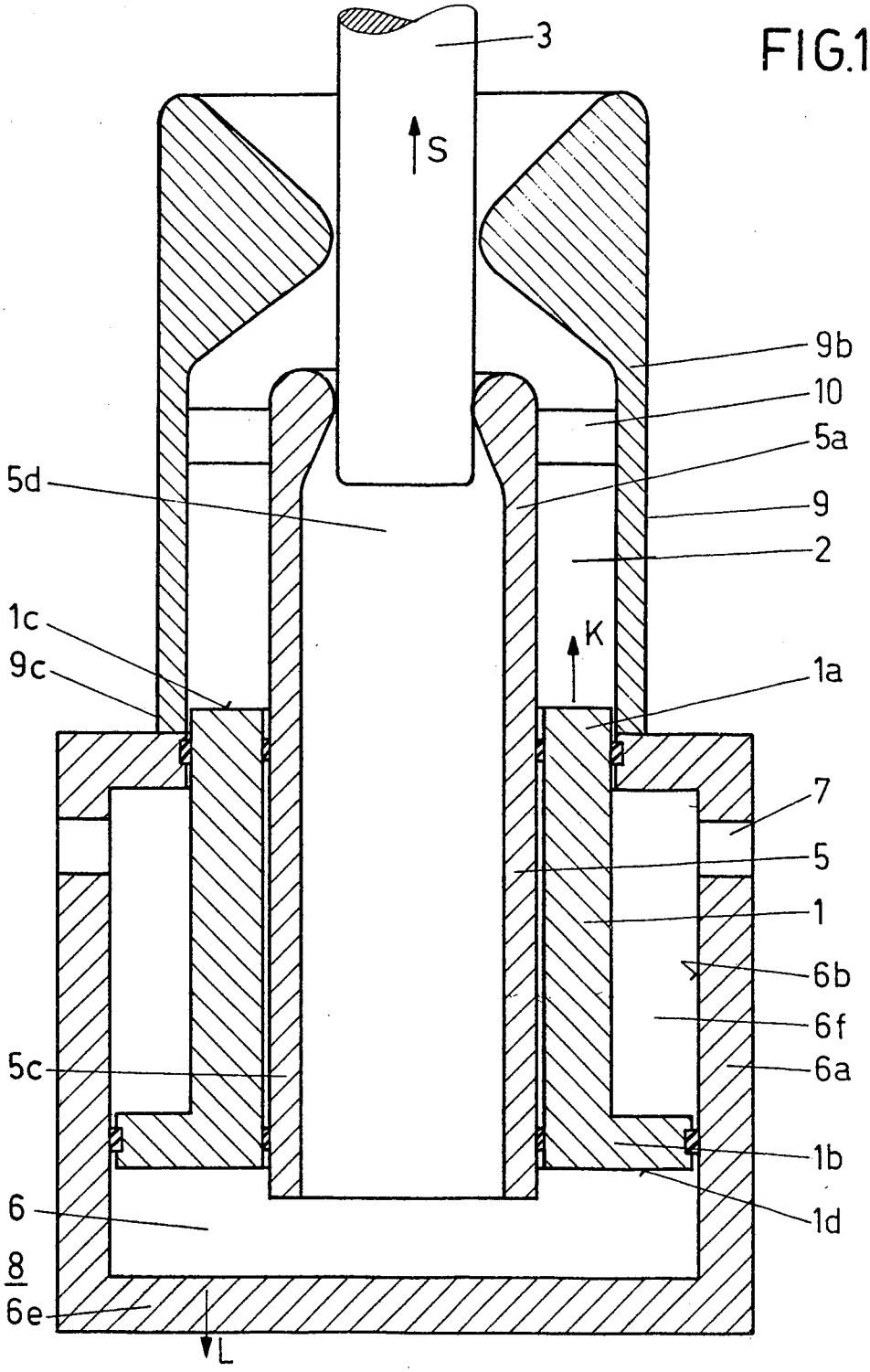
FIG. 1 illustrates a diagrammatic, sectional view of the essential parts of the arrangement proposed by the invention.

FIG. 1 illustrates the essential parts of the invention, most of them in the form of a sectional view. The piston, designed in the form of a differential diameter piston 1, runs with its part 1*a*, carrying the smaller piston area end 1*c*, between the arc-facing part 5*a* of the switch nozzle element 5 and the insulating nozzle 9 tightly sealed against the quenching medium, with the switch nozzle element 5 fastened at its arc-facing part 5*a* by means of a fixed part 10 to the arc-facing end 9*b* of the insulating nozzle 9. The other end 9*c* of the insulating nozzle 9 is connected to the boundary 6*a* of the quenching-medium expansion chamber 6. The differential diameter piston part 1*b*, carrying the larger area end 1*d*, runs between the unsupported part 5*c* of the switch nozzle element 5 and one portion of the inner boundary 6*b* of the quenching-medium expansion chamber 6, again tightly sealed against the quenching medium, and the differential diameter piston 1 is therefore able to move in the direction of the central axis which is common to said parts 1, 5, 9, and 6*a*.

However, if the differential diameter piston 1 is static, the above-mentioned parts 5, 10, 9, and 6*a*, connected to each other, are obviously jointly movable in the direction of the above-mentioned common central axis along the differential diameter piston 1 acting as a guide.

If the system comprises parts 5, 10, 9, and 6*a* and is stationary with respect to its surroundings, the differential diameter piston 1 will be moved at the time of switch-off in direction of the arrow K by a, not illustrated, drive device of a type known per se, for example by a spring action. At approximately the same time, and either independently or dependently of this movement of the differential piston 1, there is also being moved the switch contact member 3 by a, not illustrated, device of a type known per se in the direction of the arrow S, the directions of K and S being alike.

The differential diameter piston 1, by moving in direction K, will compress the quenching medium, present in the quenching-medium compression chamber 2 and possessing the initial pressure of $p_O$, to the high pressure of $p_O+p_H$, whereby the quenching medium possessing the initial pressure of $p_O$, being located in the antechamber 6*f*, is forced by the piston part 1*b* through the pressure-equalizing apertures 7 to the region 8 near the boundary 6*a* of the quenching-medium expansion chamber 6 where the initial pressure $p_0$ prevails. As soon as the switch element 3, being moved in the direction of arrow S, or K respectively, disengages the switch nozzle element 5, an arc is generated across the switch elements 3 and 5, while at the same time there is released the highly compressed quenching medium from the compression chamber 2, forming a quenching medium flow, i.e., a gas blast, directed at the arc. During this process the thermal energy of the arc, subjected to the blast, will accrue at the low pressure side of the quenching medium, i.e., within the hollow space 5*d* of the switch nozzle element 5, serving as quenching-medium conduit, or in the quenching-medium expansion chamber 6 respectively, in the form of a pressure increase $p_K$, raising the initial pressure $p_O$ of the quenching medium present within these areas, with the result that the increased pressure $p_O+p_K$ will become effective in the quenching-medium expansion chamber 6.

Since the system 5, 10, 9 and 6*a* remains static, the differential diameter piston 1 is pressed in the direction K by the force resulting as the product from the surface $A_{1d}$ of the larger area end 1*d* of the piston and the increased pressure $p_O+p_K$, that is additionally by the force $F_Z=A_{1d}\cdot(p_O+p_K)$, so that the piston 1 is additionally driven, or the above-mentioned, not illustrated drive mechanism of the piston 1 is correspondingly boosted in its operation, or eased respectively, by the converted thermal energy of the arc.

In order to give a practical example of the pressure ratios during the switch-off operation, it is assumed that the pressure increase $p_H$ in the quenching-medium compression chamber 2 by the differential diameter piston 1 is:

$$p_H=8 \text{ to } 10 \text{ bar}$$

while the pressure increase $p_K$ in the quenching-medium expansion chamber 6 is:

$$p_K=4 \text{ bar}$$

If a differential diameter piston 1 is used where its smaller area end 1*c*, facing the quenching-medium compression chamber, has a surface area of $A_{1c}$, and its ratio to the surface area $A_{1d}$ of the larger end 1*d*, facing the quenching-medium expansion area, is $$A_{1c}:A_{1d}=1:2,$$

the amplified influence and effectiveness of the thermal energy produced by the arc, utilized in connection with the quenching medium flow as well as the drive of the moving components of the switch becomes quite obvious.

The high pressure $p_O+p_H$, resulting from the compression in the quenching-medium compression chamber 2, and referred to above in connection with the solution of the problem, is always greater than the first-mentioned increased pressure $p_O+p_K$, which is the result of the heating-up of the quenching medium in the expansion chamber 6.

Figure 2:
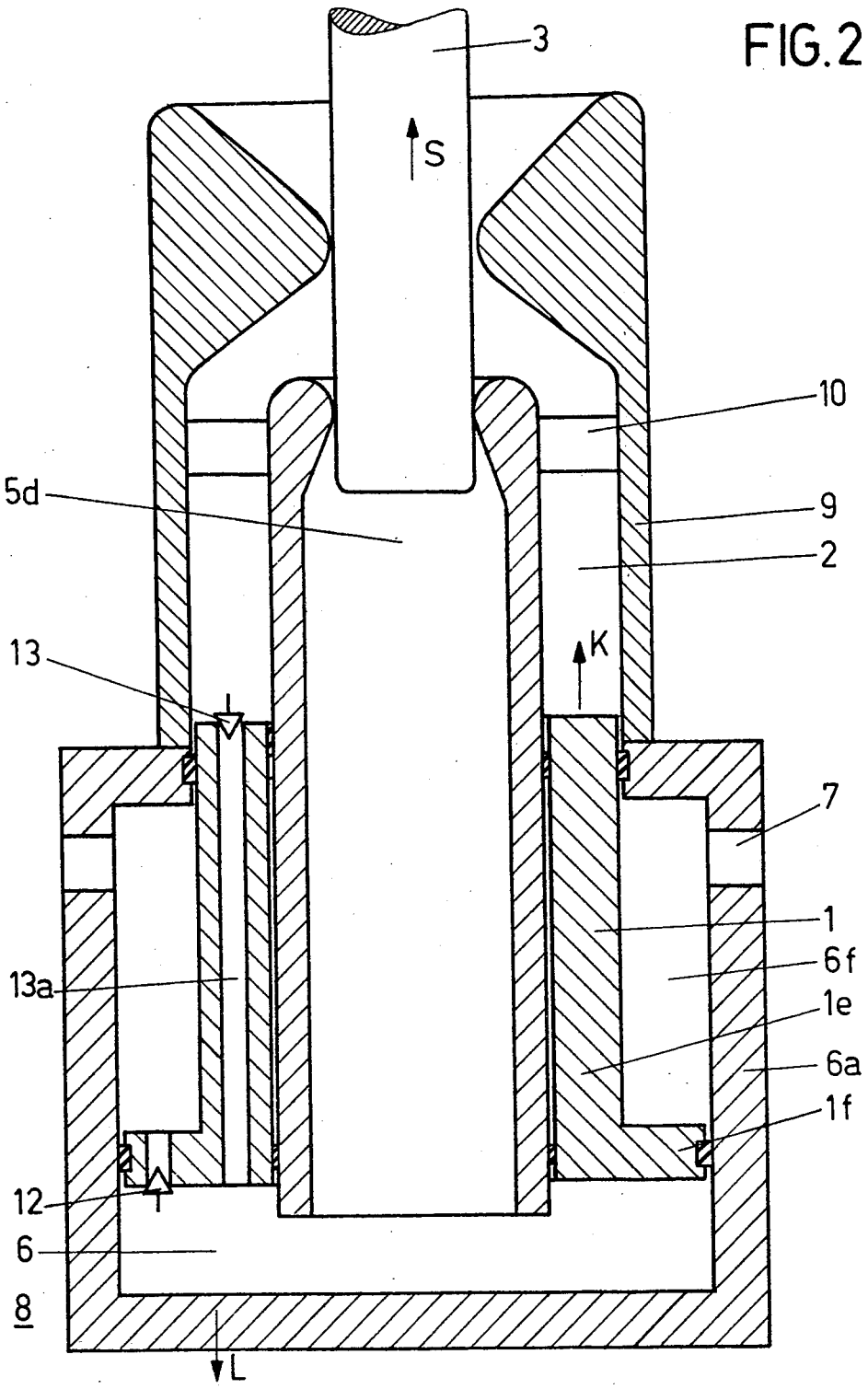
FIG. 2 shows the diagram of FIG. 1 with valves added thereto.

Regarding the possibility that a switching-on of the compression switch might lead to a build-up of pressure in the quenching-medium expansion chamber 6, exceeding the pressure in the compression chamber 2, reference is made to the further development of the invention as illustrated in FIG. 2.

When the flow of the quenching medium, i.e., the period of blasting is about to be ended, the part 1*b* of the differential diameter piston will clear the pressure-equalizing apertures 7 for passage by the heated quenching medium, thus allowing the increased pressure $p_K$ to bleed into the region 8 which is under the initial pressure $p_O$, and preventing a counterflow by the heated quenching medium, into the quenching action.

If the above described arrangement is reversed and the differential diameter piston 1 becomes static while the previously static system, comprising the parts 5,10,9, and 6*a*, is now moved in the direction of arrow L by a drive mechanism, not illustrated and known per se, the above given explanation, based on FIG. 1 applies correspondingly to the functioning of this inversely operating species of the invention.

Since the differential diameter piston 1 is now stationary, the increased pressure $p_O+p_K$ in the quenching-medium expansion chamber 6 will act upon the end wall 6*e* of the boundary 6*a* of the quenching-medium expansion chamber 6—in a manner equivalent to the action on the piston 1 which was assumed to be movable in the previous example—resulting in a movement by the boundary 6*a*, or by the entire system 5, 10, 9, and 6*a* respectively, in the direction of the arrow L, an inverse operation which will not change in any manner the above dsscribed effect of the pressure increase $p_O+p_K$.

FIG. 2 depicts a further development of the invention shown by FIG. 1. Components which are identical in FIGS. 1 and 2 are denoted by like reference symbols.

In order to prevent the formation of a negative pressure in the quenching-medium expansion chamber 6 relative to its surrounding region or the quenching chamber 8 respectively in the case of switching operations involving low currents, there is provided at least one non-return valve 12 between the quenching-medium expansion chamber 6 and the surrounding region or quenching chamber 8. If the expansion chamber 6 is under negative pressure, the non-return valve 12 is open and the surrounding region 8 will remain in communication with the quenching-medium expansion chamber 6 by way of the open pressure-equalizing aperture 7 and the antechamber 6*f* at identical pressure until pressure equalization has been accomplished. FIG. 2 also shows that the non-return valve 12 passes through the ring-shaped flange 1*f* of the differential diameter piston 1.

Another non-return valve 13 is arranged between the expansion chamber 6 and the compression chamber 2 to prevent a build-up of pressure in the expansion chamber 6 that is greater than the pressure in the compression chamber 2 when the switch is being turned on. This arrangement allows any excess pressrure to flow into the quenching-medium compression chamber 2 by way of the passage 13*a* arranged within the piston 1 and the non-return valve 13 which is open in case of excess pressure, said passage 13*a* making its way through the tubular portion 1*e* and the ring-shaped flange 1*f* of the differential piston 1.

Figure 3A:
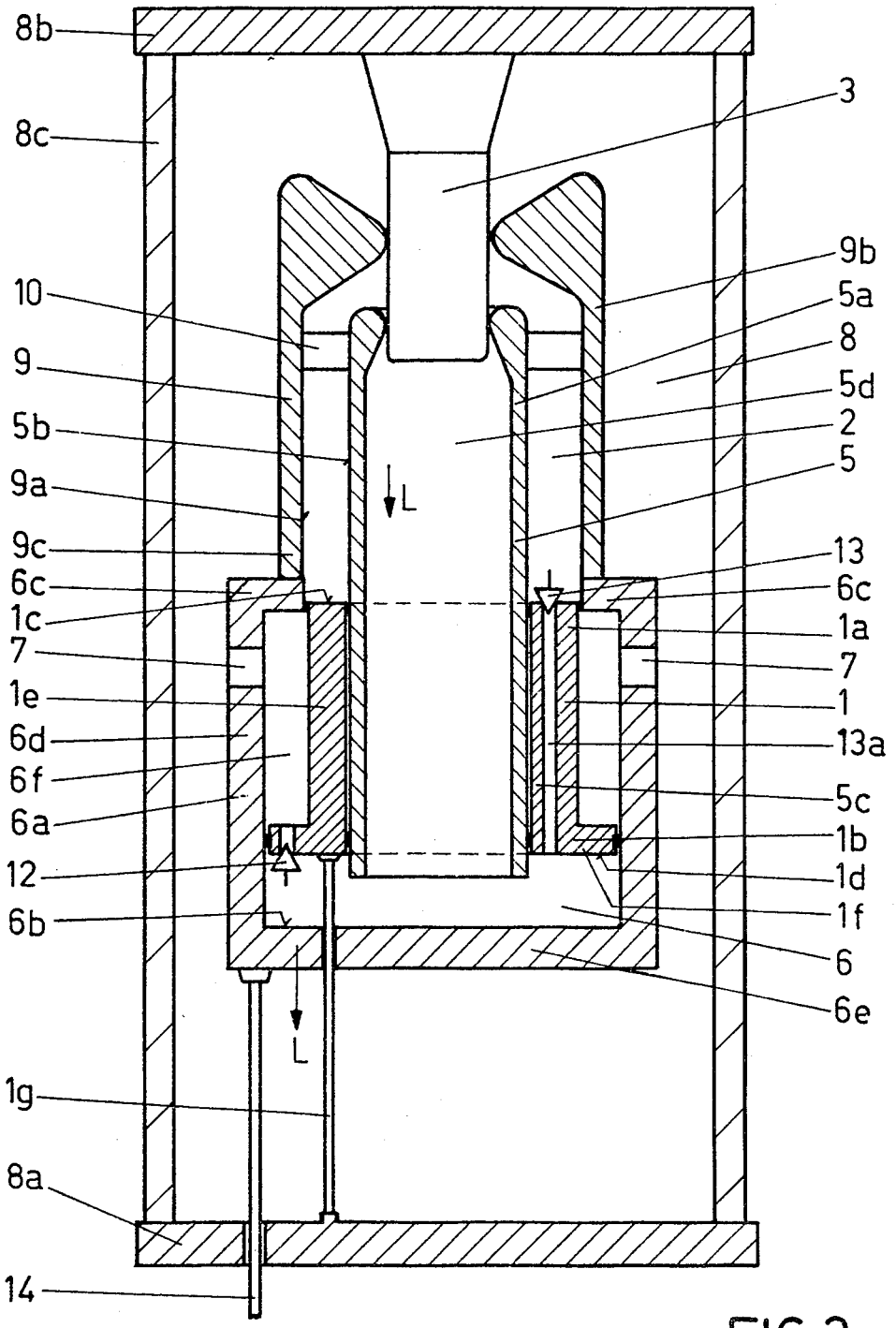
FIGS. 3*a* to 3*c* depict simplified sectional views of one species of the invention with a stationary differential diameter piston, with FIG. 3*a* illustrating the on-, and FIG. 3*c* the off-position, and FIG. 3*b* showing one switch-off phase with arcing in progress.

FIG. 3*a* gives a simplified sectional view of a compression switch proposed by the invention with static differential piston 1 in the switched-on position. Components which are identical with components shown in FIGS. 1 and 2 are denoted by like reference symbols in this FIG. 3*a*.

The stationary differential piston 1 is fixedly arranged at the quenching chamber end cover plate 8*a*, facing the drive mechanism, by means of a rod 1*g*, and the stationary switching contact member 3 is connected to the quenching chamber cover plate 8*b*, facing the switching mechanism, and an insulative cylinder 8*c* is placed between the two end cover plates 8*a* and 8*b*.

The drive of the compression switch is indicated figuratively by an insulating rod 14 which at the time of switch-off is moved in the direction of arrow L, with the quenching chamber being stationary, causing the parts 5, 10, 9, and 6*a* of the compression switch to move likewise in the same direction.

FIG. 3*a* shows that the quenching-medium compression chamber 2 is closed during the switched-off state by the fixedly arranged switch contact member 3, while the, likewise fixedly arranged, differential diameter piston 1 is arranged thusly that the volume of the quenching-medium compression chamber 2 is at its maximum. The antechamber 6*f* has likewise its maximum volume and is in communication with the quenching chamber 8 by way of the pressure-equalizing apertures 7. The quenching-medium expansion chamber 6 has, together with the hollow space 5*d* of the switch nozzle element 5, its minimum volume, this volume being closed off against the quenching chamber 8, the antechamber 6*f* as well as against the compression chamber 2, with the initial pressure $p_O$ existing in the areas 2, 5*d*, 6, 6*f*, and 8.

Figure 3B:
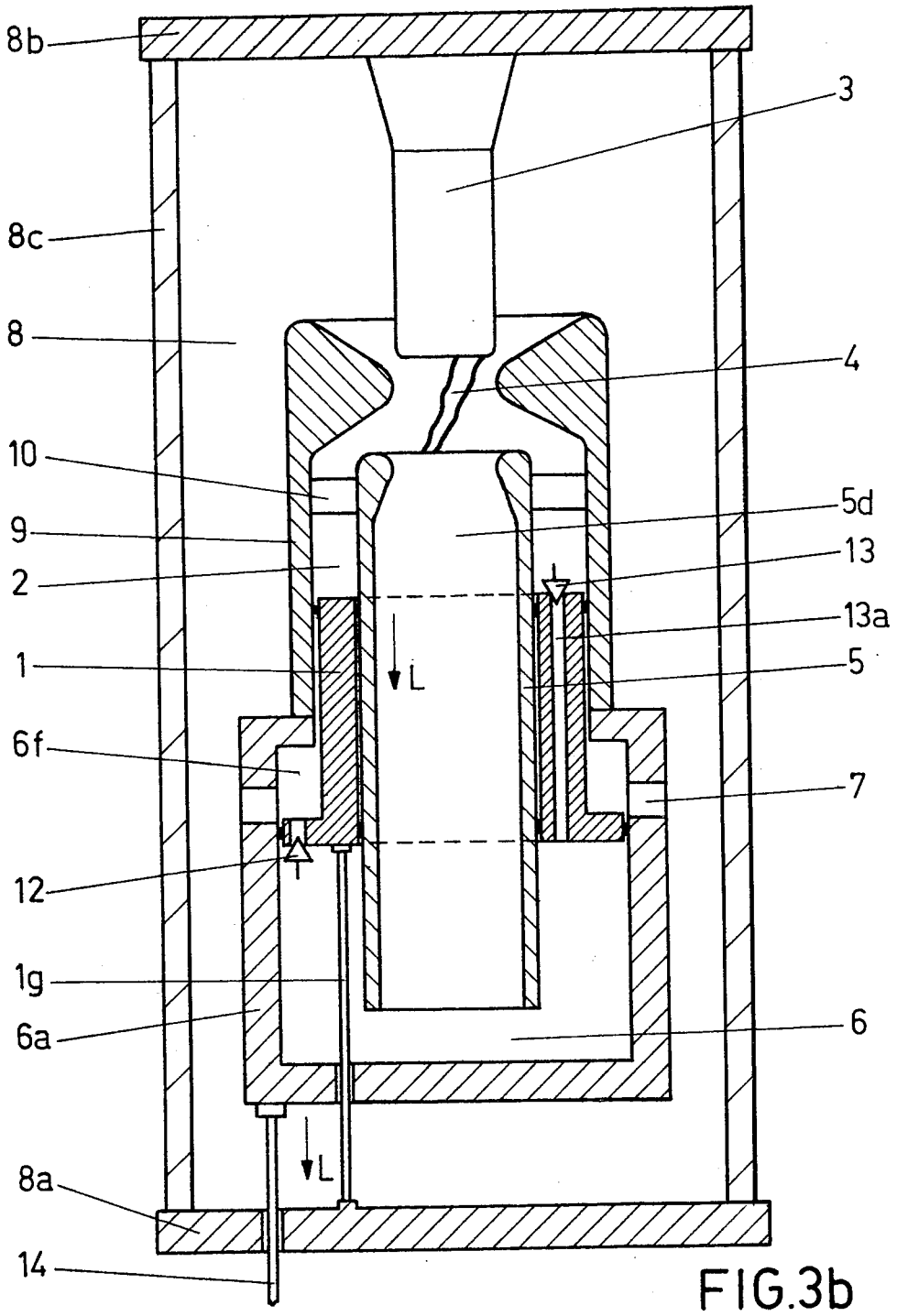

FIG. 3*b* shows the compression switch of FIG. 3*a* in an advanced phase of switch-off with arcing 4. The components shown by FIG. 3*b* are identical with the components of FIG. 3*a* and are therefore denoted by like reference symbols.

In this specific switch-off phase, the system comprising parts 5, 10, 9, and 6*a* has been moved by the insulating rod 14, which symbolizes the drive mechanism, in direction L toward the quenching chamber cover plate 8*a* which faces the drive mechanism. This movement relative to the stationary parts 1 and 3 has reduced substantially the volume of the quenching-medium compression chamber 2, thus causing a compression of the quenching medium, and the switch contact member 3 has opened the way for a flow by this compressed quenching medium in the direction of the arc 4. One portion of the quenching medium, at the same time heated-up by the arc 4, has flown through the hollow space 5*d* of the switch nozzle element 5 into the quenching-medium expansion chamber 6 and, while expanding there, has increased the size of the closed chamber 6 by moving its boundary 6*a* in the direction of arrow L to the position illustrated in co-action with the drive 14. The build-up of the high pressure ($p_O+p_H$) within the quenching-medium compression chamber 2 as well as the pressure increase ($p_O+p_K$) in the quenching-medium expansion chamber 6 is realized on the basis of the respective switch, the current to be handled, the drive mechanism of the switch and the like by an appropriately designed switch construction.

Figure 3C:
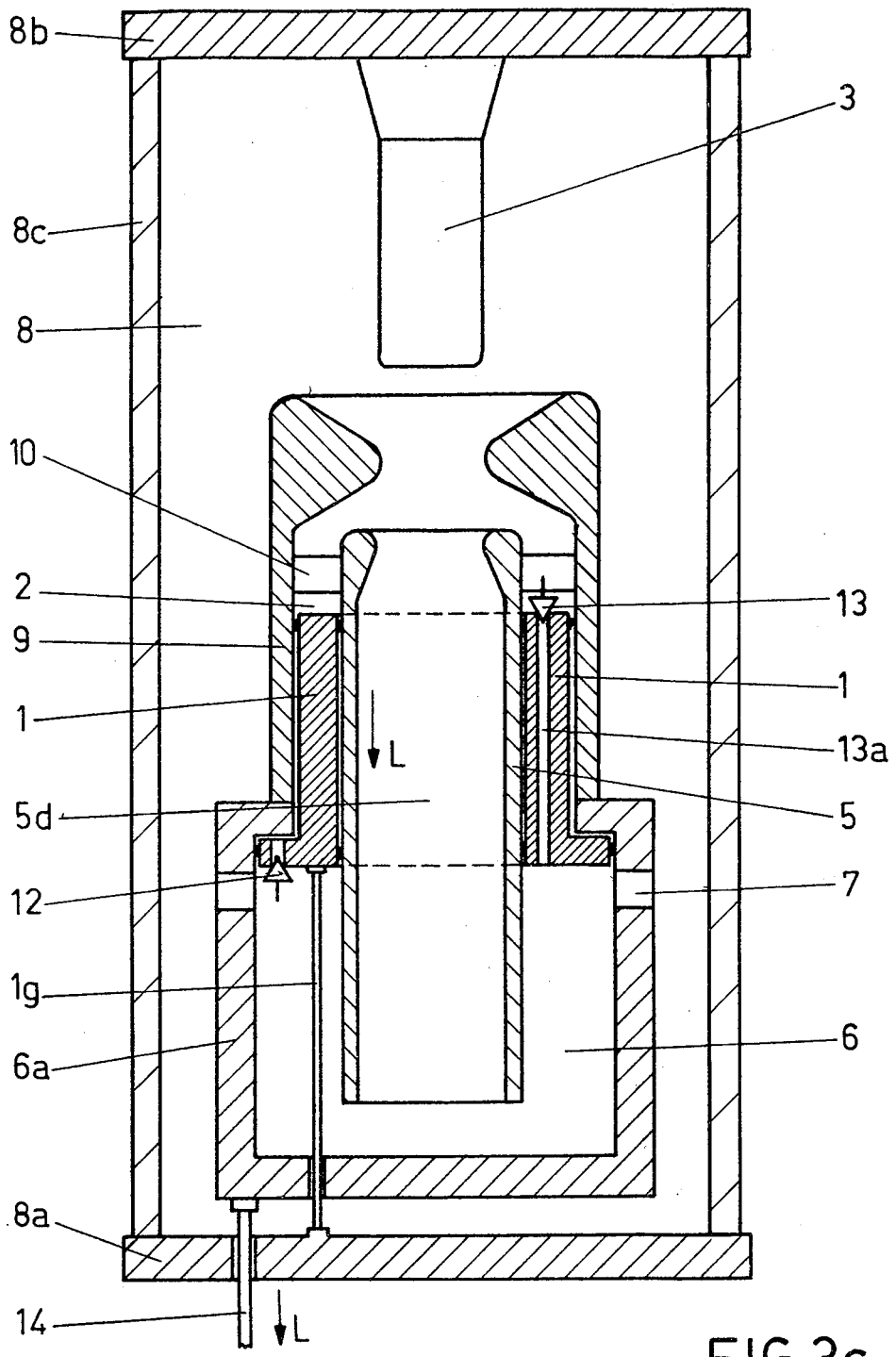

FIG. 3*c* shows the switch of FIGS. 3*a* and 3*b* in its off-position, the parts again identified in the same manner as in FIG. 3*b*.

The parts 5, 10, 9, and 6*a* which were moved in the direction of arrow L by the drive 14 in co-action with the quenching medium heated by the arc 4 have now reached the position where the switch is turned off completely. The arc is extinguished, the quenching-medium compression chamber 2, now at its minimum volume, is open toward the quenching chamber 8 by way of the insulating nozzle 9, and the pressure equalization can thus take place freely. The quenching-medium expansion chamber 6 has reached its maximum volume and is also in communication with the quenching chamber 8 by way of the apertures 7 which are now open, permitting pressure equalization.

Figure 4A:
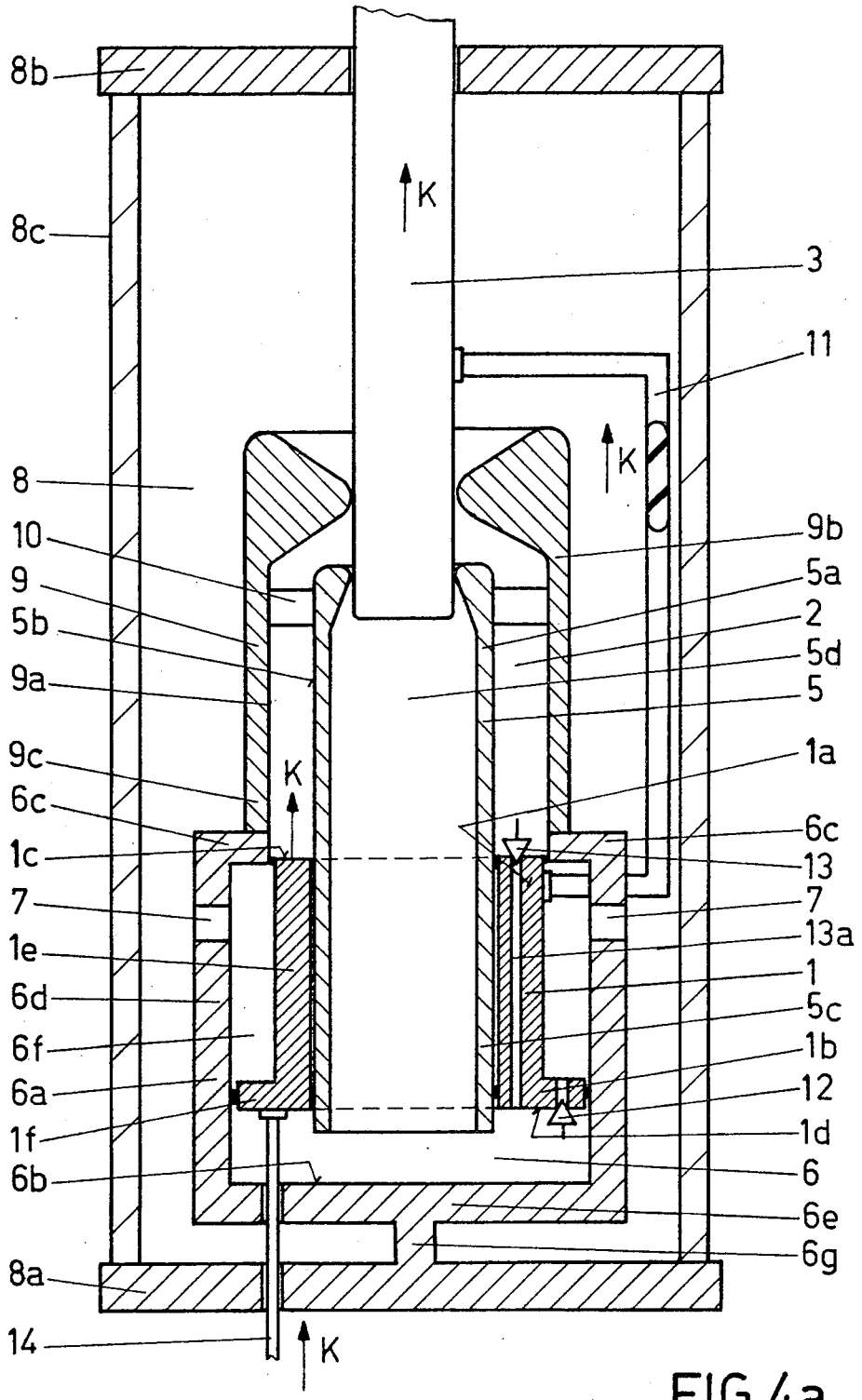
FIGS. 4*a* to 4*c* depict simplified sectional views of another species of the invention with a movable differential diameter piston, FIGS. 4*a* and 4*c* again illustrating the on- and off-position respectively, and FIG. 4*b* one phase of the switch-off.

FIG. 4*a* gives a simplified section view of a compression switch proposed by the invention with a movable differential piston 1 in the on-position, and components which are identical with the components of FIG. 3*a* are denoted by like reference symbols.

Figure 4B:
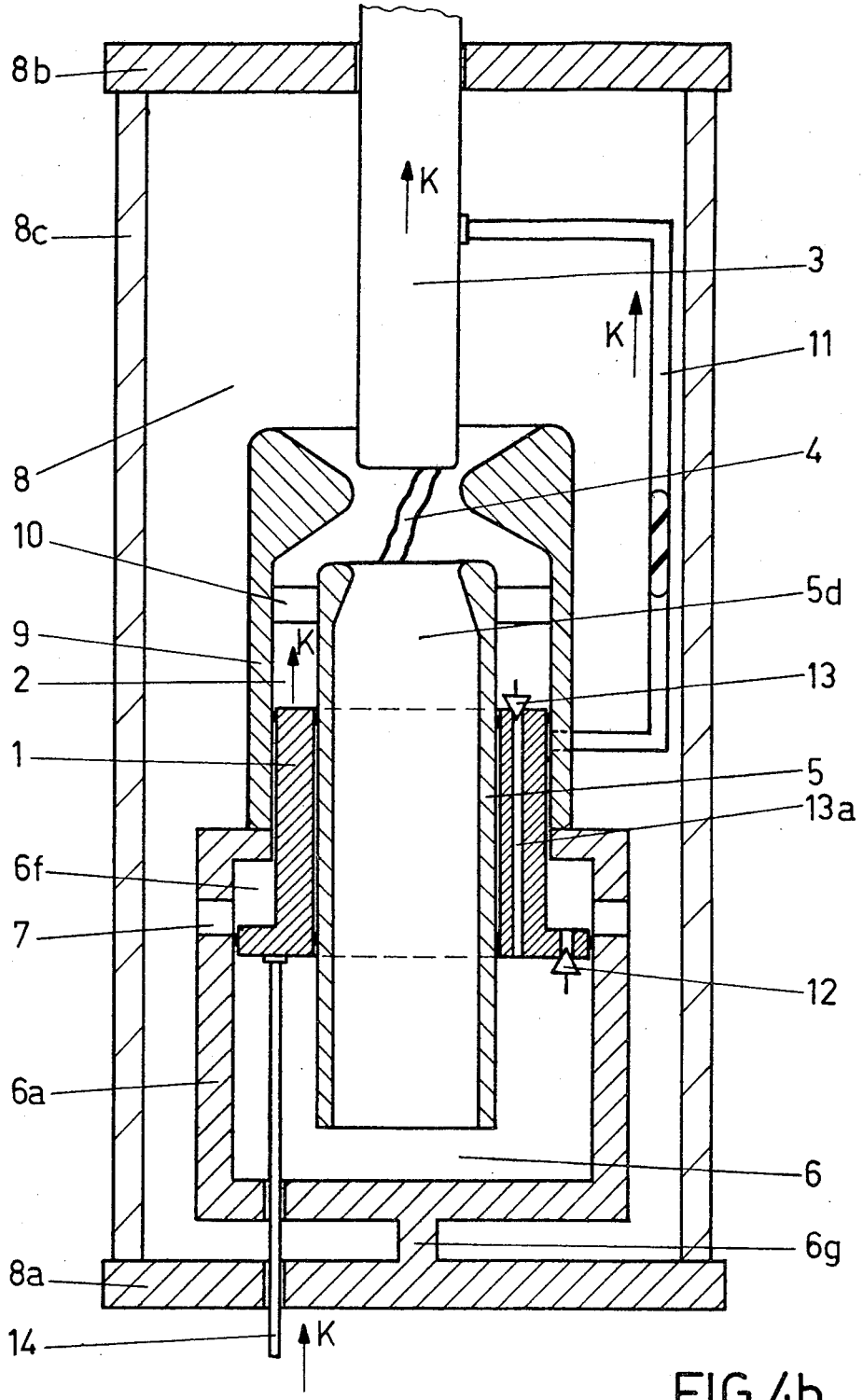
Figure 4C:
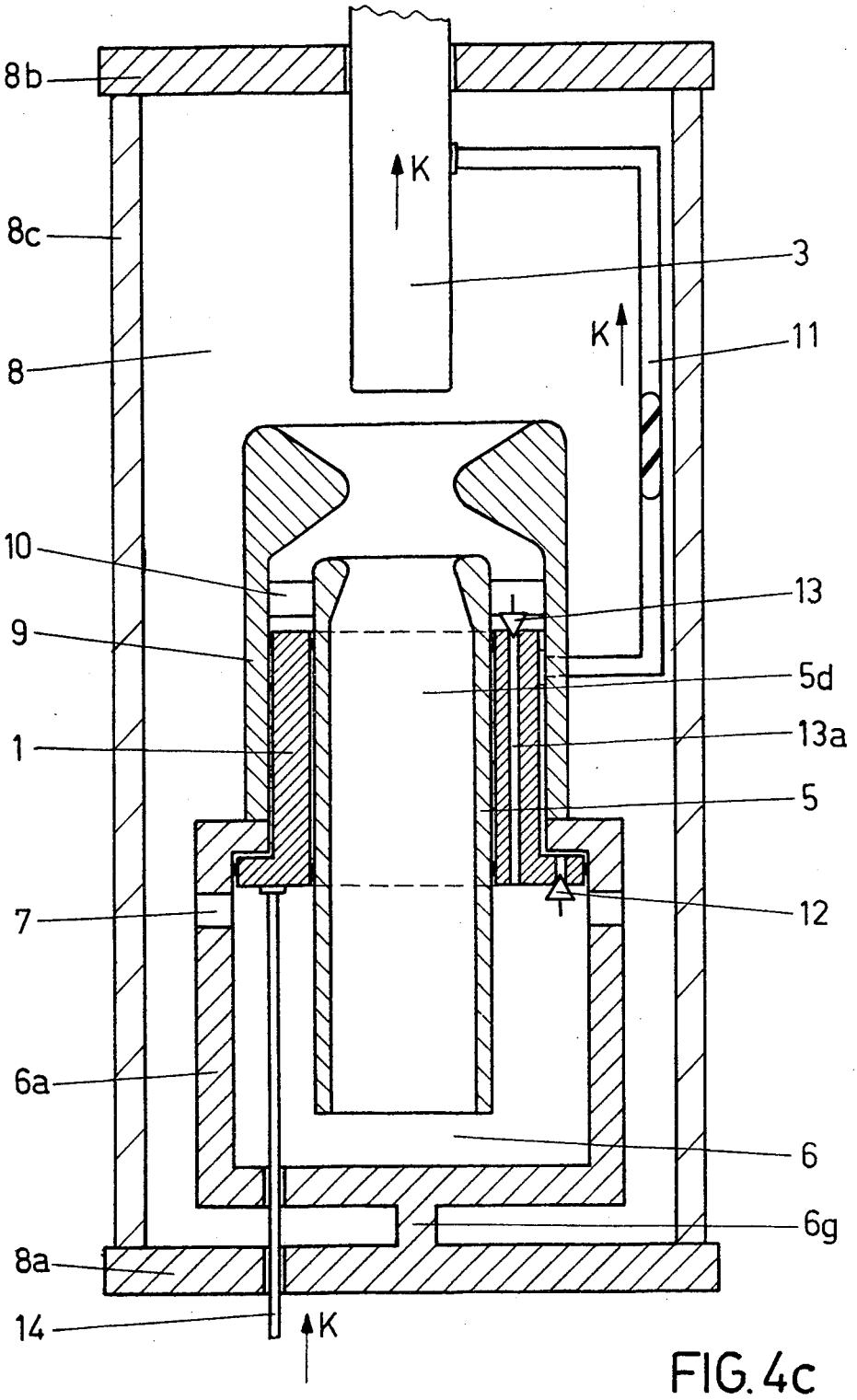

The system comprising the parts 5, 10, 9, and 6*a*, which is movable in the case of the species illustrated by FIGS. 3*a* to 3*c*, is fastened in the case of the species shown by FIGS. 4*a* to 4*c* to the quenching chamber cover plate 8*a*, facing the drive mechanism, by means of a mounting part 6*g* and is thus arranged stationary together with the quenching chamber 8.

In further development of the invention the, now movable, switch contact member 3 is coupled mechanically with the differential piston 1 by means of an insulating part 11.

The insulating rod 14, which symbolizes the drive of a type known per se, is secured to the movable differential piston 1. When the compression switch is being switched off, the system which now comprises the parts 1, 11, and 3 is moved in the direction of arrow K, and the switch will operate in the same manner as described in connection with FIGS. 3*a* to 3*c*.

FIG. 4*b* shows the compression switch of FIG. 4*a*, like in FIG. 3*b*, in an advanced phase of switch-off with arcing 4, and FIG. 4*c* shows the switch in its completely switched-off position, with like parts identified in the same manner as in FIG. 4*a*.

The various species of the invention, illustrated in FIGS. 1 to 4*c*, show in accordance with a preferred design the tubular switch nozzle contact element 5 being surrounded coaxially and at a specific distance by a tubular insulating nozzle 9, where the insulating nozzle 9 is connected by way of an annular spacing flange 6*c* to the tubular jacket 6*d* of the boundary 6*a* of the quenching-medium expansion chamber 6, FIGS. 3*a*–4*a*, the jacket 6*d* being arranged coaxially to the switch nozzle contact element 5, and where the inner diameter of the switch nozzle contact element 5 is smaller than the inner diameter of the jacket 6*d*, and the tubular jacket 6*d* is closed off opposite the unsupported part 5*c* of the switch nozzle contact element 5 by the end wall 6*e*. The tubular jacket 6*d* also carries at its end adjacent the flange 6*c* pressure-equalizing apertures 7 which are cleared by the differential piston part 1*b* possessing the larger end area 1*d* when the compression switch is in its off-position.

The differential diameter piston 1 is formed from a tube 1*e*, its part 1*b* with the larger end area 1*d* consisting of an annular flange 1*f* which has the same inner diameter, but a larger external diameter than the tube 1*e*, with the result that the illustrated embodiments of the invention are distinguished by their axial symmetry and particularly simple construction.

Obviously, the invention is not limited to the species shown by the drawing.

It is the essence of the invention concerning the compression switch that upon the compression of the quenching medium which is present in the switch as well as its release in the form of a quenching medium flow, the thermal energy produced by the arc at the low pressure side of the quenching medium flow which is directed at the arc will effectively contribute in the form of a pressure increase of the quenching medium in accomplishing the compression of the quenching medium and/or assist in the drive of the compression switch or of the moving parts of this switch, where the drive can be designed for example in the form of a spring-actuated drive.

It is possible, to design the quenching-medium compression chamber, the conduction of the quenching medium with increasing pressure being obtained at the low-pressure side, as well as the quenching-medium expansion chamber in a manner that differs from the arrangements illustrated by the drawings. It is possible, for example, to arrange the piston which compresses the quenching medium in such manner that it will co-act with a compression chamber that is arranged separately with respect to the switching elements and the insulating nozzle, with the compression chamber and the piston being arranged asymmetrically to the switching elements. Even the quenching-medium expansion chamber can be arranged independently of the insulating nozzle, and the conduction of the quenching medium heated by the arc can be accomplished in a manner that differs from the solutions shown by the species illustrated by the drawings, the only requirement being that the thermal energy, obtained in the form of a pressure increase, should be routed to the quenching-medium expansion chamber by way of a conduit involving minimum losses.

I claim:

1. In an electrical compression switch, the combination comprising means forming a switch contact chamber containing a pressurized gaseous arc quenching medium and a pair of contacts one of which is a pin contact and the other a tubular nozzle contact for receiving said pin contact, a tubular nozzle member made of insulating material surrounding said pin contact in engagement therewith and also surrounding said tubular nozzle contact in spaced relation to establish a compression chamber therebetween for the arc quenching medium, means forming an expansion chamber for the arc quenching medium within said switch chamber adjacent said tubular nozzle member of insulating material, a tubular differential diameter piston surrounding said tubular nozzle contact, the peripheral surface at the larger diameter end of said tubular piston and having the larger end surface area being slidable in a gas-sealed manner along the wall of said quenching medium expansion chamber and the opposite smaller diameter end of said tubular piston having the smaller end surface area being slidable with its internal and external surfaces in a gas-sealed manner along the external surface of said tubular nozzle contact and the internal surface of said tubular nozzle member of insulating material respectively, and means for effecting movement of said pin contact and said differential piston considered as one unit relative to said nozzle contact, said tubular nozzle member of insulating material and said quenching medium expansion chamber considered as another unit to effect disengagement of said switch contacts and separation between said pin contact and said tubular nozzle member of insulating material as well as relative movement between said differential piston and said tubular nozzle member of insulating material in such direction as to decrease the volume of said compression chamber for the arc quenching medium and thereby increase the pressure of the quenching medium on the arc drawn between said contacts, and assist in switch contact movement.

2. An electrical compression switch as defined in claim 1 and wherein said expansion chamber for said arc quenching medium includes at least one aperture through the wall thereof for pressure equalization between said expansion chamber and said switch chamber when said switch contacts are in the fully disengaged position and said aperture has been cleared by the larger diameter end of said differential piston.

3. An electrical compression switch as defined in claim 1 and which further includes a non-return valve at the smaller diameter end of said differential piston closing off a passageway through the piston to said expansion chamber for said arc quenching medium.

4. An electrical compression switch as defined in claim 1 and which further includes a non-return valve at the larger diameter end of said differential piston closing off a passageway through the piston from said expansion chamber for said arc quenching medium into a space formed between said piston and the wall of said expansion chamber.

5. An electrical compression switch as defined in claim 1 wherein the unit consisting of said pin contact and differential piston is stationary and the unit consisting of said expansion chamber for the arc quenching medium, the tubular nozzle member of insulating material and the tubular nozzle contact is movable.

6. An electrical compression switch as defined in claim 5 wherein said pin contact is secured to an end closure plate for said switch chamber, said differential piston is connected to the opposite end closure plate of said switch chamber and drive means for actuating the switch contacts are connected to said expansion chamber for the arc quenching medium.

7. An electrical compression switch as defined in claim 1 wherein the unit consisting of said pin contact and differential piston is movable and the unit consisting of said expansion chamber for the arc quenching medium, the tubular nozzle member of insulating material and the tubular nozzle contact is stationary.

8. An electrical compression switch as defined in claim 7 wherein said expansion chamber for the arc quenching medium is secured to an end closure plate of said switch chamber.

9. An electrical compression switch as defined in claim 7 wherein said movable pin contact is connected to said differential piston and drive means for actuating the switch contacts are connected to the piston.

* * * * *